US005112438A

United States Patent [19]

Bowers

[11] Patent Number: 5,112,438

[45] Date of Patent: May 12, 1992

[54] PHOTOLITHOGRAPHIC METHOD FOR MAKING HELICES FOR TRAVELING WAVE TUBES AND OTHER CYLINDRICAL OBJECTS

[75] Inventor: Harold C. Bowers, Rancho Palos Verdes, Calif.

[73] Assignee: Hughes Aircraft Company, Los Angeles, Calif.

[21] Appl. No.: 619,541

[22] Filed: Nov. 29, 1990

[51] Int. Cl.[5] ..... B44C 1/22; C23F 1/02; C25D 5/02

[52] U.S. Cl. ..... 156/655; 156/643; 156/656; 156/659.1; 156/345; 205/118; 427/116; 427/282; 315/3.5

[58] Field of Search ..... 156/643, 655, 656, 659.1, 156/661.1, 664, 345; 430/296, 313, 314, 315, 323, 317, 318, 329; 310/348, 179; 315/3.5; 330/43; 427/98, 116, 282; 204/2, 15, 25, 3, 9

[56] References Cited

U.S. PATENT DOCUMENTS 3,110,098 11/1963 Sobierajski ..... 156/656 X 3,508,108 4/1970 Salisbury ..... 156/645 X

*Primary Examiner*—William A. Powell

*Attorney, Agent, or Firm*—Terje Gudmestad; Wanda K. Denson-Low

[57] ABSTRACT

The helix (10) of the slow wave structure of a travelling wave tube is formed on a steel mandrel (12) by depositing the metal (44) of the helix on the mandrel and then coating the deposited metal with a photo resist (46). A laser light beam (24,26), having a cross section in the form of a short line, is focused upon the resist and moved linearly along the axis of the mandrel while the mandrel is rotated. The resulting helical exposure pattern on the photo resist is developed and the remainder of the undeveloped resist is then removed to expose a helical pattern (50,52) of deposited helix metal (44). The latter is subjected to etching processes so as to remove the deposited metal between the turns of the helical resist pattern (54,56), leaving a helix (44) of deposited metal on the mandrel underneath the resist. The resist is then removed and the mandrel etched away to leave the completed helix.

27 Claims, 2 Drawing Sheets

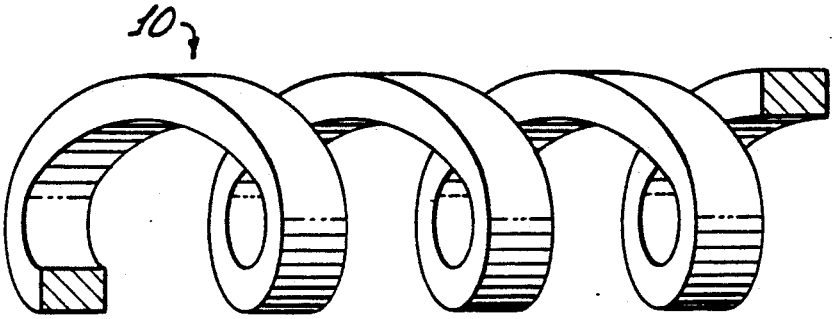
FIG. 1.
FIG. 2.
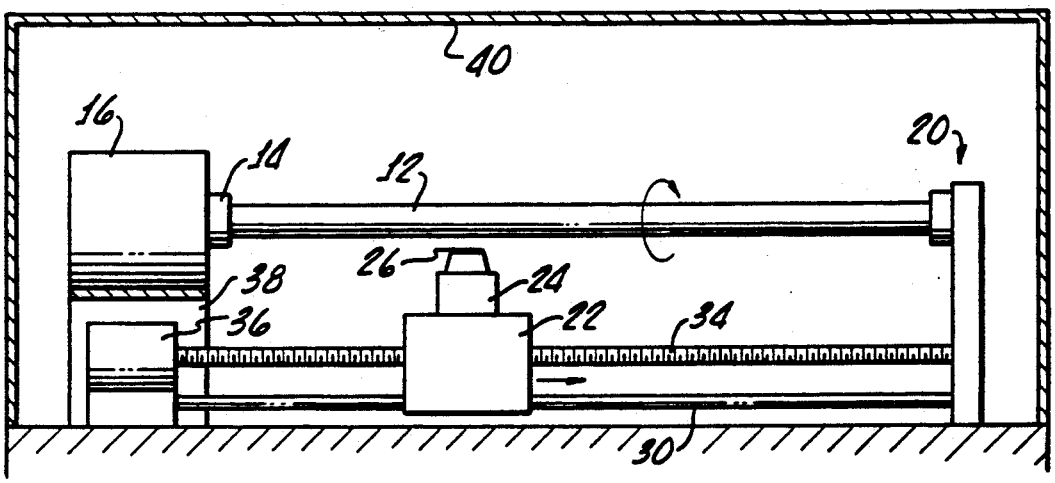
FIG. 7.
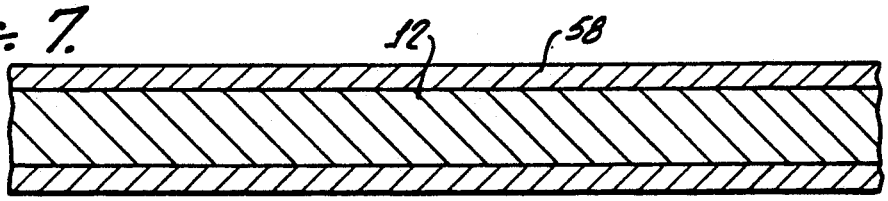
FIG. 8.
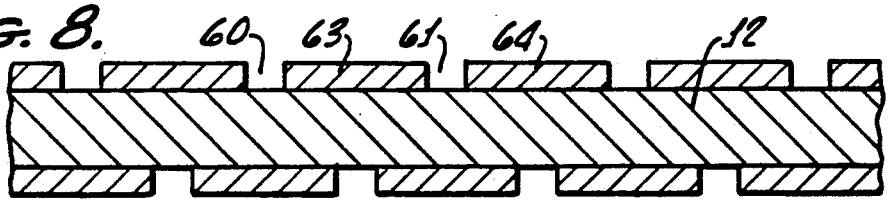
FIG. 9.
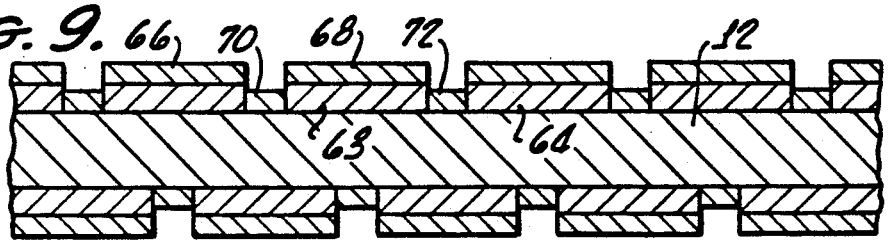

PHOTOLITHOGRAPHIC METHOD FOR MAKING HELICES FOR TRAVELING WAVE TUBES AND OTHER CYLINDRICAL OBJECTS

BACKGROUND OF THE INVENTION

1. Field of the Invention

The present relates to traveling wave tubes and more particularly concerns the helix of the slow wave structure of such tubes and a method of manufacture of such helix, or manufacture of other cylindrical objects.

2. Description of the Related Art

In travelling wave tubes, a stream of electrons is caused to interact with a propagating electromagnetic wave in a manner that amplifies energy of the electromagnetic wave. To achieve desired interaction between the electron stream and the electromagnetic wave, the latter is propagated along a slow wave structure such as an electrically conductive helix that is wound about the path of the electron stream. The slow wave structure is conveniently explained as providing a path of propagation for the electromagnetic wave that is considerably longer than the straight axial length of the structure so that the traveling electromagnetic wave may be made to propagate axially at nearly the same velocity as the electron stream. More accurately described, the wave does not travel along the helix but travels along the axis of the helix at a speed much less than the speed of light in a vacuum because of boundary conditions imposed by the helix.

Slow wave structures of the helix type may be supported within a tubular housing by means of a plurality of longitudinally disposed dielectric rods that are circumferentially spaced about the slow wave helix structure. Various other means are available for supporting the helix within its envelope.

Typical slow wave structures of the prior art are disclosed in U.S. Pat. No. 3,670,196 to Burton H. Smith, U.S. Pat. No. 4,115,721 to Walter Fritz, U.S. Pat. No. 4,005,321 to Arthur E. Manoly, U.S. Pat. No. 4,229,676 to Arthur E. Manoly, U.S. Pat. No. 2,851,630 to Charles K. Birdsall, and U.S. Pat. No. 3,972,005 to John E. Nevins, Jr., et al.

The helix of the slow wave structure in the prior art is generally manufactured by winding or machining techniques. For winding a helix, a thin ribbon of an electrically conductive material may be wound around a mandrel and processed to properly shape the helix to the circular configuration of the mandrel. For machining a helix, a cylinder of helix metal may be cut into the desired pattern using electron discharge machining. Both winding and machining techniques are limited to manufacture of helices of relatively large size. Using such techniques, it is exceedingly difficult to fabricate small helices that are needed for higher frequency shorter wave tubes. For traveling wave tubes operating in the millimeter wave length, at frequencies above about 20 GHz, for example, circuit components including the helix are so small that conventional manufacturing techniques for the helix result in helices of poor dimensional precision. Moreover, yield of such processes is small because of the difficulty of handling and operating upon the very small parts. Thus, prior manufacturing techniques provide helices that are not dimensionally accurate, having poor tolerances, are not of sufficiently small diameter and have less dimensional stability, at least in part due to distortion arising from removal of the helix from its mandrel.

Although photolithographic techniques are used in semiconductor and flexible cable fabrication, these processes are employed on planar surfaces and have not been employed for the manufacture of components of traveling wave tube slow wave structures.

Accordingly, it is an object of this invention to provide hollow cylindrical objects, such as helices, and manufacturing methods therefor that avoid or minimize above mentioned problems.

SUMMARY OF THE INVENTION

In carrying out principles of the present invention, in accordance with a preferred embodiment thereof, a mandrel carries a photo resist coating in which is formed a pattern of helical turns providing a first pattern between the turns of the photo resist and a second mating pattern in registration with the turns of the helical photo resist. A pattern of helix material is electroformed or sputtered on the mandrel, either in the first helical pattern between the turns of the resist, or in the second helical pattern, in registration with and beneath the turns of the resist. The resist and mandrel are then removed to leave the completed electroformed or sputtered helical object.

BRIEF DESCRIPTION OF THE DRAWINGS

In the accompanying drawings:

FIG. 1 illustrates a greatly enlarged typical helix that may be manufactured by the processes described herein;

FIG. 2 is a schematic illustration of apparatus that may be employed to form a helical pattern;

FIGS. 7–9 illustrate successive steps of a modified process for manufacture of the helix.

DESCRIPTION OF PREFERRED EMBODIMENTS

Figure 3:
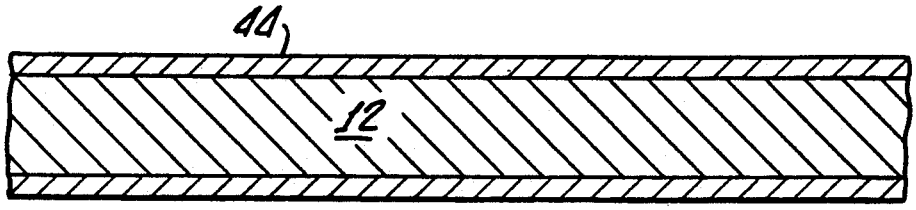
FIGS. 3–6 illustrate successive steps in the manufacture of the helix.

Methods and apparatus of this invention are applicable to manufacture of different types of hollow cylindrical objects, but will be described in connection with manufacture of helices for traveling wave tubes for purposes of exposition.

Traveling wave tubes and their slow wave structures are well known and disclosed, for example, in the United States patents identified above. The helix of a slow wave structure of a traveling wave tube is an electrically conductive ribbon having a helical configuration that is supported within and spaced from an outer envelope by a number of dielectric rods, blocks or other supports. An exemplary helix of such a slow wave structure is illustrated in FIG. 1 and generally designated by numeral 10. As previously mentioned, the dimensions of the traveling wave tube, including its helix, become ever smaller as operating frequencies increase. The availability of helices of still smaller dimensions will enable manufacture of traveling wave tubes operable at even higher frequencies. Thus, a helix for high frequency traveling wave tube operation in the order of 20 GHz or more, may have a length of between six and ten inches, an inside diameter in the order of 0.060 inches, and a cross-sectional dimension of each helix turn between about 0.01 and 0.02 inches on each side. These dimensions are provided solely as an example of the small sizes of the parts to be made and may be even smaller when parts are made by the processes to be described herein. Difficulties of precision manufacture of such small parts are apparent, particularly when tolerances as low as ±1 micrometer are required. Material of the helix is electrically conductive and generally a metal such as copper, molybdenum or tungsten is used. The helix may be of a soft copper where it is to be braised to its supporting dielectric rods. A harder metal such as molybdenum or the like is preferred when the helix is to be mounted in the tube by coining or pressure contact with its support.

A simplified illustration of apparatus that may be employed in the performing the processes of the present invention is illustrated in FIG. 2 and includes an elongated mandrel 12 supported in a chuck 14 driven by a motor 16. The mandrel is supported in an end support generally indicated at 20. An optical assembly of light source 22, focusing lenses 24, and masks 26 is mounted upon guide rods 30 for linear travel in a direction parallel to the axis of the mandrel 12 and is driven by a screw 34 which is rotated by a motor 36 carried on a support 38 that mounts the mandrel rotating motor 16. If deemed necessary or desirable, the entire apparatus may be enclosed in a housing chamber indicated at 40 to carry out certain controlled environment processing to be described below.

The mandrel is a relatively small diameter elongated cylinder having a diameter equal to the desired inner diameter of the helix 10 that is to be made by the process. The length of the mandrel is slightly longer than the length of the finished helix to enable the mandrel to be held in the appropriate tooling 14, 20. As illustrated in FIG. 3, suitable helix metal such as copper, molybdenum, or tungsten is deposited upon the mandrel 12, completely covering its circumference for the length of the desired helix. If copper is to be deposited, it may be coated or electrolytically plated upon the mandrel which is preferably made of an electrically conductive metal such as stainless steel, for example. The metal coating 44 has a thickness equal to the thickness of the desired helix that is to be made. Alternatively, the metal coating of the mandrel illustrated in FIG. 3 may be applied by chemical vapor deposition or sputtering a metal such as molybdenum. In such a case, the mandrel would be rotated by the apparatus illustrated in FIG. 1 during the sputtering process so as to obtain a uniform thickness of the metal coating. Other coating processes such as electroless plating or electrophoretic coating may be employed. If deemed necessary or desirable, a number of similar or identical mandrels may be coated simultaneously.

Figure 4:
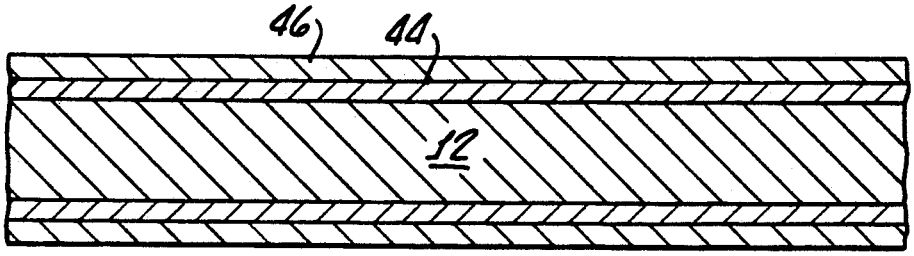
Figure 5:
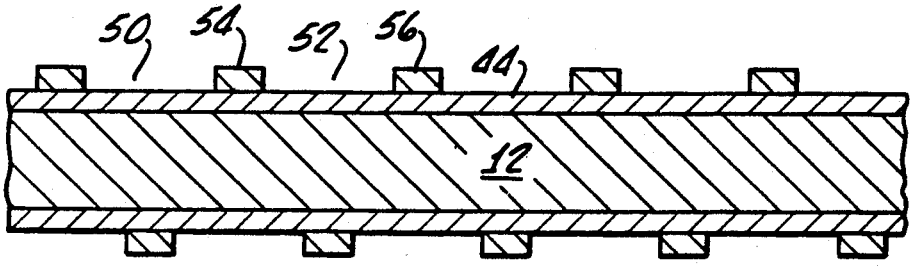

Then, as illustrated in FIG. 4, a coating of a conventional positive or negative photo resist material 46 is applied as by spraying, for example, to the metal coated mandrel. Again, to assure uniform thickness of the photo resist, the mandrel may be rotated during application of the photo resist. The photo resist will then be optically exposed, developed, and have its exposed portions removed according to well known photolithographic processes so as to provide a helical pattern of photo resist as illustrated in FIG. 5. This step is performed employing the apparatus of FIG. 2 including the traversing optical assembly 22, 24, 26. Alternatively, the photo resist can be exposed by ultraviolet light, x-rays or electron beams.

A suitable light source, such as the laser indicated at 22, is focused by means of optics 24 through a mask 26 onto the coated mandrel so as to expose a short line. The shape of the light beam exiting the mask and impinging upon the photo resist is defined by the mask 26. The short line of light that is projected on the photo resist extends in a direction parallel to the axis of the mandrel and has a length equal to the distance (in the direction of the helix axis) between windings of the helix to be formed, for a positive resist. If a negative resist is used, the line of light has a length equal to the width of a winding, which is preferred if the distance between windings is to be varied. With the short line of the optical beam impinging upon the photo resist, the mandrel is rotated at a fixed speed, and, simultaneously, the entire optical assembly is driven at a fixed speed in a linear path precisely parallel to the axis of the mandrel so that a helical pattern of the photo resist is exposed to the light. Either speed may be varied, as will be explained below, if a varying helical pitch is desired. The resist is then developed, and for a positive photo resist the exposed portion of the resist is removed, leaving a pattern of photo resist as illustrated in FIG. 5. Spaces such as spaces 50 and 52 between adjacent resist helical turns 54, 56 define a first helical pattern. The turns 54,56 of the resist define a second helical pattern of exposed helix metal.

Figure 6:
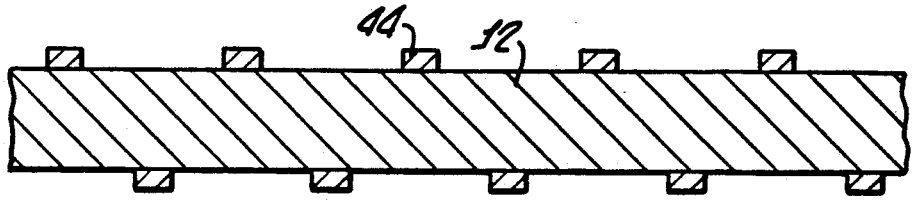

In the process illustrated in FIGS. 3–5, after removal of the exposed portions of the photo resist, exposed areas of the deposited metal 44 are then removed by a conventional etching solution. This leaves a helical pattern of deposited metal directly beneath the developed photo resist helix including its turns 54, 56 so that with the developed helical pattern of photo resist subsequently removed or stripped from the mandrel the assembly appears as illustrated in FIG. 6. Now the mandrel may be removed by a conventional etching process leaving the completed helix 10 as shown in FIG. 1.

If deemed necessary or desirable, the mandrel may be reused by first coating the mandrel with a suitable release material. For example, a coating of tungsten oxide may be used for a tungsten helix wound on a tungsten mandrel. The coating is interposed between the mandrel surface and the first coating of metal 44. Then, after removing the helical resist pattern from the helically etched metal, the interposed release coating can be etched away to enable release and removal of the helix from the mandrel and to allow the mandrel to be reused.

FIGS. 7–9 illustrate a modification of the process described above. In this arrangement, as shown in FIG. 7, the mandrel 12 is first completely coated with a photo resist 58 to a thickness that is equal to or greater than the thickness of the desired helix that is to be made. Then, employing the apparatus and techniques illustrated and described in connection with FIG. 2, a light beam, configured in a short line extending axially of the mandrel, is caused to impinge on the photo resist and moved in a helical pattern along the helical resist by simultaneously rotating the mandrel and linearly moving the optical assembly at fixed speeds. In this method, the length of the line of light in a direction parallel to the axis of the mandrel is equal to the width of the helix winding for positive resist or to the distance (measured axially) between adjacent turns of the desired helix for a negative resist. The exposed resist is then developed and the exposed (or unexposed) material removed to leave a helical pattern of resist 63,64 as illustrated in FIG. 8. In this arrangement, it should be noted that the resist is effectively formed as a negative pattern so that spaces such as 60 and 61 between adjacent turns of resist 63 and 64 define the width of the metal helix that is to be manufactured. The width of the individual helical turns 63, 64 is defined by the length of the optical line that is projected through the optical mask 26 to impinge upon the photo resist. Now, as illustrated in FIG. 8, the mandrel exhibits a first helical pattern formed by spaces 60, 61 between adjacent turns of the resist 63, 64 and a second helical pattern in registration with the helical photo resist turns 63, 64. The pattern formed by the spaces 60, 61 is a positive pattern for the desired metal helix and on this positive pattern will be formed the desired metal helix.

To this end, as illustrated in FIG. 9, the metal of the helix is formed upon the mandrel and helical resist pattern to provide the deposited metal 66, 68, covering the photo resist 63, 64 and deposited metal 70, 72 in the spaces between the adjacent turns of the photo resist 63, 64. The deposited metal 70,72 forms the helix that is an end product of this process. The helix metal may be deposited on the resist covered mandrel in the step illustrated in FIG. 9 by any suitable coating process, including various types of electroforming or sputtering as previously described. That portion of the deposited metal, if any, such as areas indicated at 66, 68 in FIG. 9 that adhere to the photo resist 63, 64 may then be removed together with the helically patterned photo resist. This will leave only the helical metal pattern 70,72 on the mandrel 12. The mandrel 12 is subsequently etched away in the manner previously described, and there remains only the completed helix 10.

Although, in the arrangement of FIGS. 7-9, a standard photo resist material has been employed to form the helical pattern on the mandrel, it will be readily appreciated that other arrangements can be employed. For example, instead of employing a photo resist, the mandrel may be completely coated with a layer of inert electrically nonconductive material such as Teflon to a thickness equal to or greater than the desired thickness of the helix. Then, the Teflon coating may have a helical grooved pattern identical to the spaces 60, 61, illustrated in FIG. 8, ablated therein by a laser such as an excimer laser. In such an arrangement, the optical assembly 22, 24, 26 is replaced by a laser having its beam appropriately configured and sized so that when the laser is longitudinally shifted in a linear path parallel to the mandrel axis while the mandrel is simultaneously rotated, a helical groove is ablated in the Teflon coating completely through the Teflon to the mandrel, thus exposing the electrically conductive mandrel surface in a positive helical pattern. This exposed mandrel surface may then be subjected to electroforming, such as electrolytic or electroless plating, for example, to deposit the metal that is to form the helix. After removing the mandrel and the Teflon, the completed helix remains. In this embodiment the helix metal may be applied, alternatively, by sputtering.

Laser ablation of a helical groove in the Teflon coating has the advantage of increased precision of geometry and control of dimensions of the configuration of the resulting helix because the laser ablated groove dimensions and configurations may be more accurately and precisely controlled, and walls of a laser ablated groove may be more precisely perpendicular to the mandrel surface.

The methods and apparatus described above have been discussed in connection with the manufacture of a helix for the slow wave structure of a traveling wave tube and will provide the advantages of increased precision, accuracy, and repeatability with concomitant improved yield and performance for manufacture of smaller and smaller helices. Nevertheless, the disclosed methods and apparatus may also be applied to manufacture of other hollow cylindrical objects, including electrical circuitry to be formed on a non-planar surface. Electrical circuits having a configuration of generally helical form or other patterns having a non-planar configuration may be made by the described processes. Examples of such helix derived electrical circuits include ring bar, folded helix, contra-wound helix and bifilar helix. Thus, in making a helix derived electrical circuit employing the method of FIGS. 7-9, for example, when optically exposing the photo resist 58, the light source may be modulated, to be turned on and off, according to a predetermined program, while the light source is moving parallel to the mandrel axis and the mandrel is rotating. For manufacture of electrical circuitry, the beam of the light source is caused to be focused to a point, rather than to a line. By turning the light source off and on during the relative linear and rotational motion of the light source and mandrel and, further, by relatively varying rotational speed of the mandrel and linear velocity of the optics, a wide variety of patterns may be achieved.

As mentioned above, to obtain a helix having a uniform pitch throughout its length, the rotational speed of the mandrel and the linear velocity of the optics relative to the mandrel are both fixed throughout the optical exposure. Where it is desired to vary the helix pitch as, for example, to decrease helix pitch so as to cause axial velocity of the traveling wave of the traveling wave tube to decrease in a manner corresponding to decrease of axial velocity of the electron stream, the rotational velocity and the translational velocity of the mandrel and optics may be increased or decreased respectively.

There have been disclosed methods and apparatus for manufacture for photolithographic manufacture of helices for traveling wave tubes that provide for devices of significantly smaller sizes and thus of higher frequencies and resulting in greater yield of smaller, more precise, helix structures.

What is claimed is:

1. A method for making a helix for a slow wave structure of a traveling wave tube comprising the steps of:
   - forming an elongated cylindrical mandrel,
   - applying a coating of a photo resist to said mandrel,
   - processing said photo resist to form a spiral pattern of photo resist having a plurality of helical turns winding helically around said mandrel to provide a first helical pattern between adjacent ones of said helical turns, and a second helical pattern in registration with said helical turns,
   - applying a pattern of electrically conductive material to said mandrel in registration with one of said first and second helical patterns,
   - removing said pattern of photo resist from said mandrel and pattern of electrically conductive material, and
   - removing said mandrel from said electrically conductive material.

2. The method of claim 1 wherein said step of applying a pattern of electrically conductive material comprises electroforming.

3. The method of claim 1 wherein said step of applying a pattern of electrically conductive material comprises sputtering.

4. The method of claim 1 wherein said step of applying a pattern of electrically conductive material comprises electrolytic plating.

5. The method of claim 1 wherein said step of applying a pattern of electrically conductive material comprises electroless plating.

6. The method of claim 1 wherein said step of applying a pattern of electrically conductive material comprises coating said mandrel with said electrically conductive material before applying said photo resist, and removing electrically conductive material from said mandrel in said first pattern to leave electrically conductive material on said mandrel in said second pattern.

7. The method of claim 1 wherein said step of applying a coating of a photo resist comprises applying said photo resist directly to said mandrel, and wherein said step of applying said electrically conductive material comprises applying said electrically conductive material to said mandrel in said first pattern after said step of processing said photo resist.

8. The method of claim 1 wherein said step of applying said electrically conductive material comprises coating said processed photo resist and mandrel with said electrically conductive material after said step of processing said photo resist.

9. The method of claim 1 wherein said step of processing said photo resist comprises impinging an optical beam of small dimensions upon an impingement area of said photo resist, rotating said mandrel, and relatively moving said mandrel and optical beam to shift said impingement area along said mandrel.

10. The method of claim 1 wherein said step of processing said photo resist comprises impinging an optical beam of small dimensions upon said photo resist in one of said first and second helical patterns.

11. Apparatus for making a helix for a slow wave structure of a traveling wave tube comprising:

a mandrel, means for supporting the mandrel for rotation about its axis, means for rotating said mandrel, energy source means for directing an energy beam at said mandrel, said energy source including means for shaping said beam into a selected configuration at said mandrel, and means for shifting said energy source means along said mandrel.

12. The apparatus of claim 11 wherein said means for rotating the mandrel and said means for shifting the energy source means include means for rotating the mandrel while the energy source means shifts along the mandrel to cause the energy beam to traverse a helical path along the mandrel.

13. The apparatus of claim 11 wherein said means for shaping said beam comprises means for causing said beam to impinge upon said mandrel along a short line having a length that defines the width of the helix to be made.

14. The apparatus of claim 11 including means for coating said mandrel.

15. The apparatus of claim 11 including means for coating said mandrel with an electrically conductive material having a thickness equal to the thickness of the helix to be formed on the mandrel.

16. The apparatus of claim 11 including means for coating the mandrel with a photoresistive material having a thickness not less than the thickness of the helix to be formed on the mandrel.

17. A method for making a helix derived device comprising the steps of:

forming an elongated cylindrical mandrel, applying a coating of photo resist to said mandrel, processing said photo resist to form a pattern of photo resist having a plurality of helical turns that wind around said mandrel to provide a first helical pattern between adjacent ones of said helical turns, and a second helical pattern in registration with said helical turns of said photo resist, applying a pattern of device material to said mandrel in registration with one of said first and second helical patterns, removing said pattern of photo resist from said mandrel and pattern of device material, and removing said mandrel from said device material.

18. The method of claim 17 wherein said step of applying a pattern of device material comprises coating said mandrel with said device material before applying said photo resist, and removing device material from said mandrel in said first pattern to leave device material on said mandrel in said second pattern.

19. The method of claim 17 wherein said step of applying said device material comprises applying said device material to said mandrel in said first pattern after said step of processing said photo resist.

20. The method of claim 17 wherein said step of processing said photo resist comprises impinging an energy beam of small dimensions upon said photo resist in one of said first and second helical patterns.

21. The method of claim 17 wherein said step of processing said photo resist comprises impinging an energy beam of small dimensions upon an impingement area of said photo resist, rotating said mandrel, and relatively moving said mandrel and energy beam to shift said impingement area along said mandrel.

22. The method of claim 21 wherein said helix has a predetermined width, and wherein said step of impinging an energy beam of small dimensions comprises forming an energy beam in the configuration having a length that defines said helix width.

23. The method of claim 21 wherein said mandrel is rotated at a selected rotational speed, and wherein said mandrel and optical beam are relatively moved in a linear path at a selected linear speed.

24. The method of claim 23 including the steps of relatively varying said rotational and linear speeds.

25. The method of claim 23 wherein said de vice is the helix of a slow wave structure for a traveling wave tube, and wherein said linear speed decreases relative to said mandrel speed during said processing step, thereby decreasing the pitch of said helix.

26. The method of claim 23 wherein said device is a helix derived circuit.

27. The method of claim 17 wherein said device is a helix derived circuit.

* * * * *